US005564140A

United States Patent [19]

Shoenhair et al.

[11] Patent Number: 5,564,140

[45] Date of Patent: Oct. 15, 1996

[54] FRAME ASSEMBLY FOR SUPPORTING A MATTRESS

[75] Inventors: John J. Shoenhair, New Hope; Thomas D. Embertson, Hopkins, both of Minn.

[73] Assignee: Select Comfort Corporation, Plymouth, Minn.

[21] Appl. No.: 279,120

[22] Filed: Jul. 22, 1994

[51] Int. Cl.[6] ..... A47C 19/00

[52] U.S. Cl. ..... 5/400; 5/282.1; 403/397

[58] Field of Search ..... 5/400, 412, 282.1, 5/285, 186.1, 207, 208, 201; 403/394, 395, 389, 397

[56] References Cited

U.S. PATENT DOCUMENTS

| | | | |
|---|---|---|---|
| 831,377 | 9/1906 | Roche | 403/384 |
| 1,260,531 | 3/1918 | Fiala | 403/389 |
| 2,452,642 | 11/1948 | Firsel | 5/207 |
| 4,402,097 | 9/1983 | Scott . | |
| 4,675,929 | 6/1987 | Santo . | |
| 4,734,946 | 4/1988 | Saputo . | |
| 5,144,706 | 9/1992 | Walker . | |

FOREIGN PATENT DOCUMENTS

| | | | |
|---|---|---|---|
| 2318513 | 4/1973 | Germany | 5/400 |
| 2126309 | 3/1984 | United Kingdom | 403/397 |
| 2137876 | 10/1984 | United Kingdom | 5/400 |

*Primary Examiner*—Flemming Saether
*Attorney, Agent, or Firm*—Patterson & Keough, P.A.

[57] ABSTRACT

A bed foundation for supporting a mattress in a raised position relative to a floor that includes a frame assembly, mattress support panels, and retaining elements shiftably carried by the frame assembly for securing the mattress support panel against movement in the longitudinal and transverse axes of the bed foundation. The foundation is easily disassembled for compact storage and shipping, yet provides a high quality, sturdy mattress foundation when assembled. The retaining clips include a generally inverted U-shaped in cross section clip element that is slidably carried by the frame assembly frame members, and a retaining pin that is receivable within apertures of the mattress supporting panel.

12 Claims, 1 Drawing Sheet

FRAME ASSEMBLY FOR SUPPORTING A MATTRESS

FIELD OF THE INVENTION

This invention relates to foundations for supporting mattresses. More particularly, the invention relates to bed foundations that can be disassembled into a compact configuration for storage and shipping and that can be easily assembled into a sturdy, high quality support for a bed mattress.

BACKGROUND OF THE INVENTION

Bed foundations are typically sold fully assembled. U.S. Pat. No. 5,144,706 to Walker, entitled "Bed Foundation," issued Sep. 8, 1992, and assigned to the assignee of the present application introduced a bed foundation that includes a plurality of sections designed to be easily and quickly joined together to make a rectangular support for a mattress. The bed foundation disclosed in the '706 patent can be disassembled for shipping and storage.

The bed foundation disclosed in the '706 patent has proven suitable for a wide variety of uses. The '706 bed foundation, however, includes two center sections and two opposed end sections that present hinge or crease lines transverse to the longitudinal axis of the foundation. The hinge or crease lines detract from the bed foundation's rigidity along the longitudinal axis of the foundation. Moreover, the various components of the foundation could not be easily disassembled for repair or replacement, and a failure of one of the components generally required return of the entire foundation to the factory for repair. A bed foundation that could be disassembled into a compact unit for storage and shipping, that did not require hinge or crease lines transverse to the longitudinal axis of the foundation, but could be disassembled for compact storage and shipping, and which would easily facilitate the repair or replacement of component parts would provide decided advantages over known bed foundations.

SUMMARY OF THE INVENTION

The bed foundation hereof provides a sturdy, high quality support for a bed mattress, while at the same time is capable of being disassembled in to a compact configuration for storage and shipping. The bed foundation is specially designed to provide for easy setup, and includes a unique retaining mechanism for securing the mattress support surface to the bed foundation frame. Individual components of the foundation can be easily detached for repair or replacement.

The bed foundation broadly includes a foundation frame assembly having longitudinal and transverse frame members, a plurality of mattress support panels, and a plurality of retaining clips carried by the longitudinal and transverse frame members for securing the mattress support panel to the frame. The mattress support panel retaining clips each include a generally inverted U-shaped in cross section element. The clip elements can be slidably positioned along the upper surfaces of the longitudinal and transverse frame members and the retaining pins are receivable in a press fit within apertures in the mattress support panels. The mattress support panels are secured by the pins against movement in the longitudinal and transverse axes of the bed foundation.

DETAILED DESCRIPTION OF THE DRAWINGS

Figures 1, 2, 3:
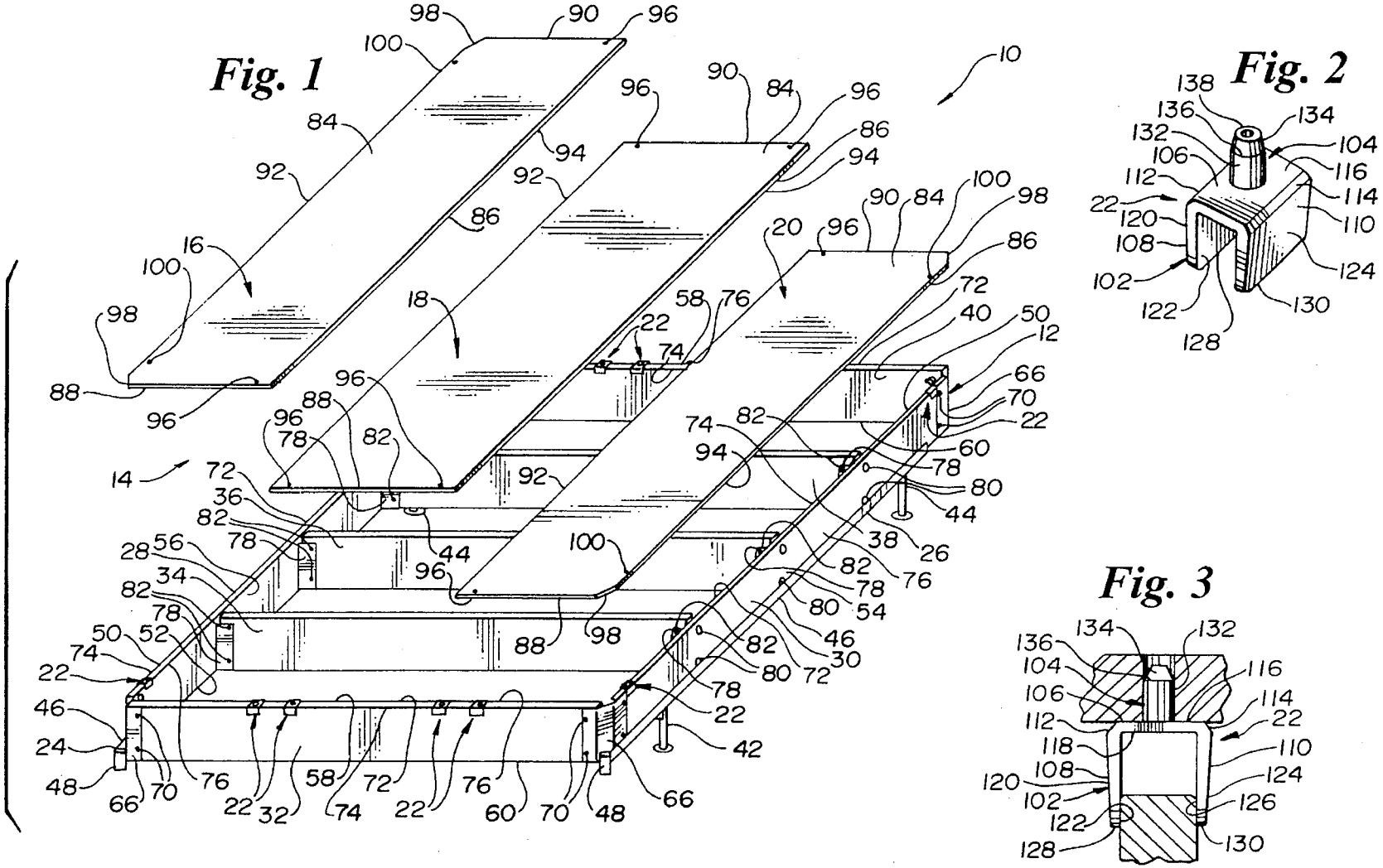
FIG. 1 is an exploded, perspective view of a bed foundation in accordance with the present invention, depicting the horizontal mattress support panels positioned over the bed foundation frame.
FIG. 2 is a perspective view of a horizontal support panel retaining clip.
FIG. 3 is a front elevational view of the retaining clip depicted in FIG. 2, depicting the clip element partially engaged with a foundation frame member, and the retaining pin received in a press fit within an aperture of a mattress support panel.

Referring to the drawings, the bed foundation 10 in accordance with the present invention broadly includes a foundation frame 12, a horizontal mattress support surface 14, comprised of a plurality of horizontal mattress support panels 16, 18, 20, and a plurality of mattress support panel retaining clips 22.

Foundation frame 12 includes a pair of opposed side channel assemblies 24, 26, a pair of longitudinal frame members 28, 30 supported by respective side channel assemblies 24, 26, and a plurality of transverse frame members 32, 34, 36, 38, 40, extending between the longitudinal frame members 28, 30.

Side channel assemblies 24, 26 each include front and rear legs 42, 44 depending downwardly from a longitudinal frame member receiving channel 46. A headboard attachment bracket 48 is carried by each channel 46.

Longitudinal frame members 28, 30 are supportingly received within the channel 46 of a respective side channel assembly 24, 26. The longitudinal frame members are preferably formed from a lightweight, sturdy material. Each longitudinal frame member 28, 30 includes an upper margin 50, lower margin 52, and opposed side surfaces 54, 56.

Transverse frame members 32, 34, 36, 38, 40 are similar in construction to the longitudinal frame members 28, 30, but, with reference to FIG. 1, are of shorter length. Each of the transverse frame members 32, 34, 36, 38, 40 include an upper margin 58, a lower margin 60 and opposed side surfaces 62, 64.

Transverse frame members 32, 40 comprise opposed front end and rear end frame members, respectively. The front and rear end transverse frame members 32, 40 are secured to the longitudinal frame members 28, 30 by corner brackets 66. The corner brackets 66 are attached to the longitudinal frame members 28, 30, and front and rear transverse frame members 32, 40 by screws 70.

With reference to FIG. 1, it will be seen that the upper margins 50 of the longitudinal frame members 28, 30 and the upper margins 58 of the transverse frame members present generally flat, upward facing surfaces 72, having squared corners 74, 76. The distance across the flat surfaces 72 between square corners 74, 76 defines a frame member width.

The midframe transverse frame members 34, 36, 38 are attached to the longitudinal frame members 28, 30 by brackets 78. The brackets 78 are attached to longitudinal frame members 28, 30 by rivet pins 80, and are attached to the transverse frame members 34, 36, 38 by screws 82.

The mattress support surface 14 is comprised of a right mattress board panel 16, a middle mattress support panel 18, and a left mattress support panel 20. The three mattress support panels are formed from a lightweight, sturdy material. The middle mattress support panel 18 includes an upper surface 84, a lower surface 86, a front margin 88, a rear margin 90, and opposed side margins 92, 94. Pin receiving apertures 96 extend between the upper surface 84 and lower surface 86 just inwardly from both the front margin 88 and rear margin 90. It will be appreciated that more or less support panels can be employed depending on the desired width of the foundation 10.

The right and left mattress support panels 16, 20 are similar to the middle panel 18, and similar features are annotated with similar numbers. Referring to FIG. 1, however, it will be noted that the right and left mattress support panels 16, 20 include beveled corners 98. The right and left mattress support panels 16, 20 also differ in construction from the middle mattress support panel 18 by the presence of pin-receiving apertures 100 extending between the upper surface 84 and lower surface 86 of the panels 16, 20 just inwardly of the respective outwardly facing side margins.

Referring to FIGS. 2 and 3, the mattress support panel retaining clips 22 each include a generally inverted U-shaped in cross section clip element 102 and a retaining pin 104.

The clip element 102 includes top wall 106 and opposed sidewalls 108, 110 pending downwardly .from respective margins 112, 114 of top wall 106. Top wall 106 includes upper surface 116 and opposed lower surface 118. Sidewall 108 includes outwardly facing surface 120 and inwardly facing surface 122. Referring in particular to FIG. 3, it will be seen that the lower surface 118 of top wall 106 and inwardly facing surface 122 of sidewall 108 are oriented generally orthogonally to each other. Sidewall 110 includes outwardly facing surface 124 and inwardly facing surface 126. Refer again to FIG. 3., it will be seen that the inwardly facing surface 126 of sidewall 110 and the lower surface 118 of top wall 106 defines an angle slightly less than 90°. The lowermost margins 128, 130 of respective sidewalls 108, 110 are oriented in a common plane oriented generally parallel to the plane defined by top wall 106, the downwardly depending length of the sidewalls 108, 110 being generally equal. The clip element 102 is generally beveled along the top wall margins 112, 114.

Retaining pin 104 projects upwardly from the upper surface 116 of top wall 106. The retaining pin 104 includes a generally tapered, cylindrical body 132, and a generally frusto-conical tip portion 134. Referring more particularly to FIGS. 2 and 3, it will seen that the juncture of the tapered, cylindrical body 132 and frusto-conical tip portion 134 defines a generally circular margin 136, and that the upper surface 138 of the tip portion 134 is generally flat. The cylindrical body 132 is tapered such that the diameter of the body 132 at its base is greater than its diameter at the circular margin 136.

In operation, the bed foundation 10 can be packaged in a disassembled compact state to facilitate both storage and shipping of the bed foundation 10. The foundation frame 12 is easily assembled on site by attaching the corner brackets 66 to the longitudinal frame members 28, 30 and front and end transverse frame member 32, 40, and securing the transverse frame member 34, 36, 38 via brackets 68 to the opposed longitudinal frame members 28, 30. The longitudinal frame members 28 are fixedly attached to by the side channel assemblies 24. The multiplicity of transverse frame members 34, 36, 38 provide the support panels 16, 18, 20 with rigidity along the longitudinal axis of the foundation 10.

Referring to FIG. 1, it will be seen that a plurality of retaining clips 22 are received along the upper margins 50 of the longitudinal frame members 28, 30, and the upper margins 58 of the front and rear transverse frame members 32, 40. The width of each clip between sidewalls 108, 110, as measured along the lower surface 118 of clip top wall 106, corresponds to the width of the longitudinal frame members 28, 30 and front and rear transverse frame members 32, 40 as measured across the top edges of the frame members. Referring to FIG. 3, it will be noted that the width of the retaining clip element 102, as measured between the lower margins 128, 130 of clip element sidewalls 108, 110, is slightly less than the aforementioned width measured along the lower surface 118 of clip element top wall 106. Accordingly, the retaining clips 22 are held in place in a slidable force fit along the upper margins 50, 58 of the longitudinal frame members 28, 30 and front and rear transverse frame members 32, 40.

Pin receiving apertures 96 located along the front and rear margins 88, 90 of middle panel 18 and the front and rear margins of the right and left mattress support panel 16, 20, and the pin receiving apertures 100 located along the side margins 92, 94 of the right and left mattress support panels 16, 20 are adapted to receive the retaining pins 104 of respective mattress support panel retention clips 22. The beveled, tip presented by the frusto-conical tip portion 134 of clip retaining pin 104 is quickly and easily received within the respective apertures 96, 100 along the designated margin of individual mattress support panels 16, 18, 20. Moreover, the diameter of the generally tapered, cylindrical body 132 of the pin 104 is slightly greater than the diameter of the pin receiving apertures such that each pin 104 is received within its respective aperture 96 in a force fit. Referring to FIG. 3, it will be appreciated that, when the panels 16, 18, 20 are lifted during movement of the bed foundation, the retaining clip 22 will move with the panel. The sidewalls 108, 110 of the clip will stay in engagement with its respective frame member (absent radical lifting of the panel), and the frame, clip and support panel will resume proper orientation without disengagement after movement of the panel has ceased.

It will be appreciated that the clip element 102 of each retaining clip 122 can be slid along the longitudinal frame member or transverse frame member it is carried by to readily position the clip retaining pins 104 in alignment with appropriate apertures 96, 100. It will also be appreciated that, because the longitudinal frame members 28, 30 are oriented transversely to the front and rear transverse frame members 32, 40, the side mattress support panels 16, 20 are positioned and maintained in a fixed longitudinal and transverse orientation by the foundation frame 12 when the retaining pins 104 of clip elements 22 are received within each of the apertures 96, 100. The retaining clip pins 104 received within the apertures 96 of the middle mattress support panel 18 retain the middle support panel 18 against the longitudinal shifting along the foundation frame 12. The middle mattress support panel 18 is held against transverse movement across the foundation frame 12 by the abutting engagement of the mattress support panel with the inner side margins of the right and left mattress panels 16, 20.

We claim:

1. A bed foundation for supporting a mattress in a raised position relative to a floor, comprising:

a frame assembly having a pair of opposed longitudinal side frame members and a transverse frame member operably coupled to and extending between said side frame members, each of said side members and transverse frame member including an upwardly facing surface presenting a frame member width;

a first mattress support panel removably supported by said frame assembly, said support panel including opposed side margins and structure defining a first pin receiving aperture oriented proximal one of said side margins and structure defining a second pin receiving aperture oriented at a distance further front said one of said side margins than said first pin aperture;

a first retaining element slidably carried along the upwardly facing surface of one of said side frame members, said first retaining element including a first retaining pin receivable within said first pin receiving aperture; and second retaining element slidably carried along the upwardly facing surface of said transverse frame member, said second retaining element including a second retaining pin receivable within said second pin receiving aperture, whereby said mattress support panel can be removably held in place by said first and second retaining pins against longitudinal and transverse movement relative to said frame assembly.

2. The invention as claimed in claim 1, said transverse frame member comprising a front transverse frame member, said mattress support panel including a front margin and said second pin receiving aperture being oriented proximal to said mattress support panel front margin.

3. The invention as claimed in claim 2, said frame assembly including a rear transverse frame member operably coupled to and extending between said side frame members and including an upwardly facing surface presenting a frame member width, said mattress support panel including a rear margin and structure defining a third pin receiving aperture oriented proximal said rear margin, said bed foundation including a third retaining element slidably carried along the upwardly facing surface of said rear transverse frame member, said third retaining element including a third retaining pin receivable within said third pin receiving aperture.

4. The invention as claimed in claim 2, including a second mattress support panel removably supported by said frame assembly, said second support panel including a side margin, front margin and rear margin and structure defining pin receiving apertures oriented proximal said side, front and rear margins, said first and second mattress support panels being oriented along opposed sides of said frame assembly.

5. The invention as claimed in claim 4, including a third mattress support panel removably supported by said frame assembly, said third support panel including a front margin and a rear margin and structure defining pin receiving apertures oriented proximal said front and rear margins, said third mattress support panel being interposed between said first and second mattress support panels.

6. The invention as claimed in claim 2, each of said retaining elements including a clip element slidably receivable along the upwardly facing surfaces of said frame members, said retaining pin projecting upwardly from said clip element.

7. The invention as claimed in claim 6, said clip element including a top wall and opposed first and second side walls depending downwardly from said top wall to present said clip element with a generally inverted U-shaped in cross section appearance.

8. The invention as claimed in claim 7, stud clip element top wall including a lower surface and said first side wall including an inwardly facing surface, said top wall lower surface and said first side wall inwardly facing surface being oriented generally orthogonally to each other.

9. The invention as claimed in claim 8, said clip element second side wall including an inwardly facing surface, said top wall lower surface and said second side wall inwardly facing surface together presenting an angle of less than 90°.

10. The invention as claimed in claim 7, said first and second clip element side walls including first and second sidewall lower margins respectively spaced apart from said top wall, said clip element-presenting a first clip element width as measured along the lower surface of said top wall between said first and second side walls, and a second clip element width as measured between said first and second side wall lower margins, said first clip element width generally corresponding to said frame member width, and said second clip element width being smaller than said first clip element width.

11. The invention as claimed in claim 10, said retaining pin including a generally cylindrical body and a generally frusto-conical tip portion.

12. A retaining element, comprising:

a clip element having a top wall and opposed first and second side walls depending downwardly from said top wall to present said clip element with a generally inverted U-shaped in cross section appearance; and a retaining pin projecting upwardly from said clip element, said clip element top wall including a lower surface and said first side wall including an inwardly facing surface, said top wall lower surface and said first side wall inwardly facing surface being oriented generally orthogonally to each other, said clip element second side wall including an inwardly facing surface, said top wall lower surface and said second side wall inwardly facing surface together presenting an angle of less than 90°.

* * * * *

UNITED STATES PATENT AND TRADEMARK OFFICE

CERTIFICATE OF CORRECTION

PATENT NO. : 5,564,140

DATED : October 15, 1996

INVENTOR(S) : Shoenhair et al.

It is certified that error appears in the above-indentified patent and that said Letters Patent is hereby corrected as shown below:

Column 3, line 25, delete ".from" and substitute therefor --from--.

Column 3, line 47, delete "will seen" and substitute therefor --will be seen--.

Column 5, line 15, delete "second" and substitute therefor --a second--.

Column 6, line 12, delete "stud" and substitute therefor --said--.

Column 6, line 24, delete "element-presenting" and substitute therefor --element presenting--.

Signed and Sealed this

Eleventh Day of February, 1997

*Attest:*

*Attesting Officer*

BRUCE LEHMAN

*Commissioner of Patents and Trademarks*